US009496652B2

(12) United States Patent
Bertsch

(10) Patent No.: US 9,496,652 B2
(45) Date of Patent: Nov. 15, 2016

(54) PLUG CONNECTOR WITH AN EARTH TERMINAL FOR AT LEAST ONE LEAD

(71) Applicant: Amphenol Tuchel Electronics GmbH, Heilbronn (DE)

(72) Inventor: Michael S. Bertsch, Heilbronn (DE)

(73) Assignee: AMPHENOL TUCHEL ELECTRONICS GMBH (DE)

( * ) Notice: Subject to any disclaimer, the term of this patent is extended or adjusted under 35 U.S.C. 154(b) by 0 days.

(21) Appl. No.: 14/410,390

(22) PCT Filed: Jun. 27, 2013

(86) PCT No.: PCT/EP2013/002232
§ 371 (c)(1),
(2) Date: Dec. 22, 2014

(87) PCT Pub. No.: WO2014/029459
PCT Pub. Date: Feb. 27, 2014

(65) Prior Publication Data

US 2015/0222058 A1 Aug. 6, 2015

(30) Foreign Application Priority Data

Aug. 22, 2012 (DE) ..... 10 2012 016 725

(51) Int. Cl.
*H01R 13/652* (2006.01)
*H01R 4/30* (2006.01)
*H01R 24/28* (2011.01)

(52) U.S. Cl.
CPC ..... *H01R 13/652* (2013.01); *H01R 4/30* (2013.01); *H01R 24/28* (2013.01)

(58) Field of Classification Search
CPC ..... H01R 4/36; H01R 13/652
USPC ..... 439/810, 814, 811, 812, 813
See application file for complete search history.

(56) References Cited

U.S. PATENT DOCUMENTS

| | | | | |
|---|---|---|---|---|
| 3,081,507 A | | 3/1963 | Gribble | |
| 4,361,371 A | * | 11/1982 | Williams | H01R 9/2425 361/752 |
| 5,000,705 A | * | 3/1991 | Kinka | H01R 4/5091 439/791 |
| 5,206,789 A | * | 4/1993 | Barbry | H01H 71/08 200/284 |
| 8,747,170 B2 | * | 6/2014 | Cornelius | H01R 4/36 439/798 |
| 2004/0077224 A1 | | 4/2004 | Marchese | |
| 2007/0274805 A1 | * | 11/2007 | Nebl | F16B 5/0266 411/307 |
| 2012/0178314 A1 | * | 7/2012 | Yu | H01R 4/36 439/810 |

FOREIGN PATENT DOCUMENTS

| | | |
|---|---|---|
| DE | 1026392 | 3/1958 |
| DE | 3117315 | 4/1982 |
| DE | 3108965 | 9/1982 |
| DE | 19804702 | 7/1999 |
| FR | 2936655 | 4/2010 |

* cited by examiner

*Primary Examiner* — Tulsidas C Patel
*Assistant Examiner* — Marcus Harcum
(74) *Attorney, Agent, or Firm* — Blank Rome LLP

(57) ABSTRACT

The invention relates to a plug connector with a plug connector housing having housing walls and an earth terminal for connecting at least one lead to the earth terminal in a clamping manner, wherein the earth terminal has a first connecting region for connecting a first lead in a clamping manner using an actuatable clamping means, and wherein the earth terminal additionally has a second connecting region for connecting a second lead in a clamping manner.

9 Claims, 4 Drawing Sheets

SECTION A-A

PLUG CONNECTOR WITH AN EARTH TERMINAL FOR AT LEAST ONE LEAD

The present invention relates to a plug connector having a protective-ground conductor connection as claimed in claim 1.

The present invention relates to a protective-ground conductor connection as claimed in claim 12, specifically a protective-ground conductor connection for a plug connector.

In spite of careful designing when creating electrical systems and prior technical planning, it has not been possible in the prior art to prevent the possibility of undesired short circuits occurring during operation of electrical systems of this kind.

Therefore, safety measures which reliably prevent harm to persons or damage to property have to be taken. The electrical operating means therefore have to be designed to be resistant to short circuits.

One of the protection options which is widespread in the prior art is the use of a protective-ground conductor connection. An extremely wide variety of designs of protective-ground conductor connections are known in the prior art.

Protective-ground conductor connections are generally designed as screw connections in which a protective-ground conductor is received by the protective-ground conductor contact in a clamping manner and is permanently fastened in this way. In particular, the DIN series DIN VDE 0100 is concerned with designs of protective-ground conductor connections in accordance with regulations.

It is therefore difficult to design a protective-ground conductor in such a way that the normative regulations are complied with but lines of different cross section and preferably more than one line can be connected to the protective-ground conductor.

If a plurality of lines are fitted to one and the same connection terminal or in one and the same connection region of a protective-ground conductor, considerable problems arise in respect of the stability and durability of the connection.

The connection to a single protective-ground conductor can generally no longer be implemented in a reliable manner particularly when lines which have a different cross section and are composed of different materials are to be connected.

In the prior art, a second protective-ground conductor is often used for applications of this kind, however said second protective-ground conductor has to be connected to the first protective-ground conductor by means of other connection means in order to produce a continuous protective-ground conductor system and to create uniform potential compensation and/or a uniform potential.

In the case of plug connectors, it is additionally necessary for an electrical connection to be established between the protective-ground conductor connections as far as possible when the plug connector is plug-connected to its mating plug.

The object of the present invention is therefore to provide an improved protective-ground conductor connection for a plug connector and therefore to provide a plug connector which can be connected to a mating plug in a simple manner and at the same time provides the option of connecting at least one line, preferably a plurality of identical or different lines. This object is intended to be achieved with the proviso that as few parts as possible are to be provided for designing the protective-ground conductor connection.

Furthermore, said protective-ground conductor connection should be simple and reliable to operate and it should be possible to produce said protective-ground conductor connection in a cost-effective manner.

The object according to the invention is achieved by a plug connector as claimed in claim 1 and a protective-ground conductor connection as claimed in claim 12.

The basic concept of the present invention is to provide a plug connector having a plug connector housing, wherein the plug connector housing provides housing walls, and said plug connector is formed with a protective-ground conductor connection, specifically for the connection of at least one line to the protective-ground conductor connection in a clamping manner, wherein the protective-ground conductor connection has a first connection region for the connection of a first line specifically to a clamping means which can be operated, in a clamping manner, and wherein the protective-ground conductor connection further has a second (preferably adjacent) connection region for the connection of a further, preferably second, line in a clamping manner.

In this case, the plug connector according to the invention advantageously uses a common clamping means for the connection of a first and/or of a second line in a clamping manner for the two connection regions.

This has the advantage that, at the same time, two different lines and therefore two different protective-ground conductors can be electrically connected to the first and second protective-ground conductive connection, and said lines can be reliably held by means of a common clamping means. Owing to this design, material for a second clamping means, amongst other things, is saved, and expenditure on assembly is also reduced.

In a preferred embodiment, the protective-ground conductor connection has a protective-ground conductor contact which forms a contact pin and has a connection block on the contact pin. The connection block is advantageously in the form of a cuboidal connection block, this resulting in a rotationally fixed mounting in or on the plug connector housing.

In a particularly advantageous embodiment, the clamping means is in the form of a screw which can be screwed in an operable manner into both the first connection section for a first line and also into the second connection section for a second line.

In a preferred embodiment, the plug connector is designed such that the first connection region and the second connection region are in the form of two regions which are spaced apart, specifically preferably in the form of two regions which are spaced apart next to one another directly in the axial direction of the screw or of the clamping means.

The first connection region is advantageously formed between a cylindrical wall section of the connection block of the protective-ground conductor contact and a housing wall of the plug connector housing, which housing wall is spaced apart from said cylindrical wall section.

In other words, the housing wall of the plug connector housing forms a bearing which adjoins a cylindrical wall section of the connection block, so that the receiving region or the connection region for receiving a line is located between said bearing and cylindrical wall section, it being possible for the clamping means or the screw to be screwed into said region in order to press the line, which is to be connected, against the housing wall and to clamp said line against said housing wall. A secure clamping connection with a cable which is to be connected or a line which is to be connected can be achieved in this way.

In a further advantageous embodiment, a clamping disk is fitted to the clamping means in the second connection region, and the second connection region is formed between the clamping means and a preferably planar side wall of the connection block of the protective-ground conductor contact, wherein the side wall serves as a clamping surface for a (second) conductor which can be received in the connection region.

As a result of this embodiment, the screw or the clamping means therefore projects both through the first and also through the second connection region and can clamp a line against the housing wall in the first connection region, while a line is clamped in a screwed manner between the clamping disk and the connection block in the second connection region. In this way, two different or identical lines can be fitted to the protective-ground conductor connection according to the invention at the same time by means of extremely simple assembly.

The clamping disk is advantageously in the form of a bent clamping disk, specifically in the form of a clamping disk which is bent in a concave manner in relation to the side wall of the connection block.

In a particularly preferred embodiment, the plug connector housing has two housing-end locking means which are in the form of a stop for the clamping disk. As a result, it is possible to ensure that, when the clamping means, that is to say the screw, is operated, said screw, in respect of its insertion depth, bears against the end such that can be operated against the locking means, and excessively deep and therefore destructive clamping of a conductor is prevented.

It is therefore advantageously possible to ensure that the screw cannot be screwed into the first and second receiving region in the protective-ground conductor connection to any desired depth. Owing to this embodiment, a broad range of line cross sections can be securely accommodated in the second receiving region.

In a particularly advantageous embodiment, the protective-ground conductor contact which has the protective-ground conductor connection has a contact pin which projects in the plugging direction S of the plug connector. The contact pin is in the form of a contact pin which can be plug-connected, and therefore, when the plug connector is plug-connected to its mating connector during the plugging process, an electrical protective-ground conductor connection to the metallic mating housing or metallic mating plug is already established.

The contact pin of the protective-ground conductor contact therefore advantageously projects through a housing flange of the plug connector housing, specifically preferably in said plugging direction S of the plug connector.

In a particularly advantageous embodiment, the connection block of the protective-ground conductor contact has a semi-cylindrical recess in order to ensure that a round conductor is fitted in as optimum a manner as possible. However, as an alternative, the recess could also be designed in another form.

The recess in the connection block forms the first connection region with the abovementioned housing wall of the plug connector housing.

Provision is advantageously further made for a threaded opening, preferably a lateral threaded opening which is made in the connection block, to be provided in the connection block in order to be able to operate the screw or, in general, a clamping means into the region of the first connection section, specifically preferably through the second connection section.

In a consequently particularly preferred embodiment, the screw projects fully through the second connection section by way of a threaded section and, at the end, into the first connection section by way of the screw end, or the screw can be operated into the two connection sections. When the screw is fully screwed-in until it comes into contact with the clamping disk, the end of the screw is located at a distance from the clamping wall, so that a sufficient gap between the end of the screw and the adjacent wall remains there.

This ensures that the plug connector is not unintentionally damaged by excessive rotation of the screw. At the same time, it is possible, by deformation of the clamping disk, to screw-in the screw a further half to complete revolution and as a result provide a maximum contact-pressure force against a conductor with the smallest conductor cross section.

Further preferred embodiments of the invention are defined in the dependent claims.

A first exemplary embodiment of the present invention is described in the text which follows with reference to the figures, in which.

Figure 1:
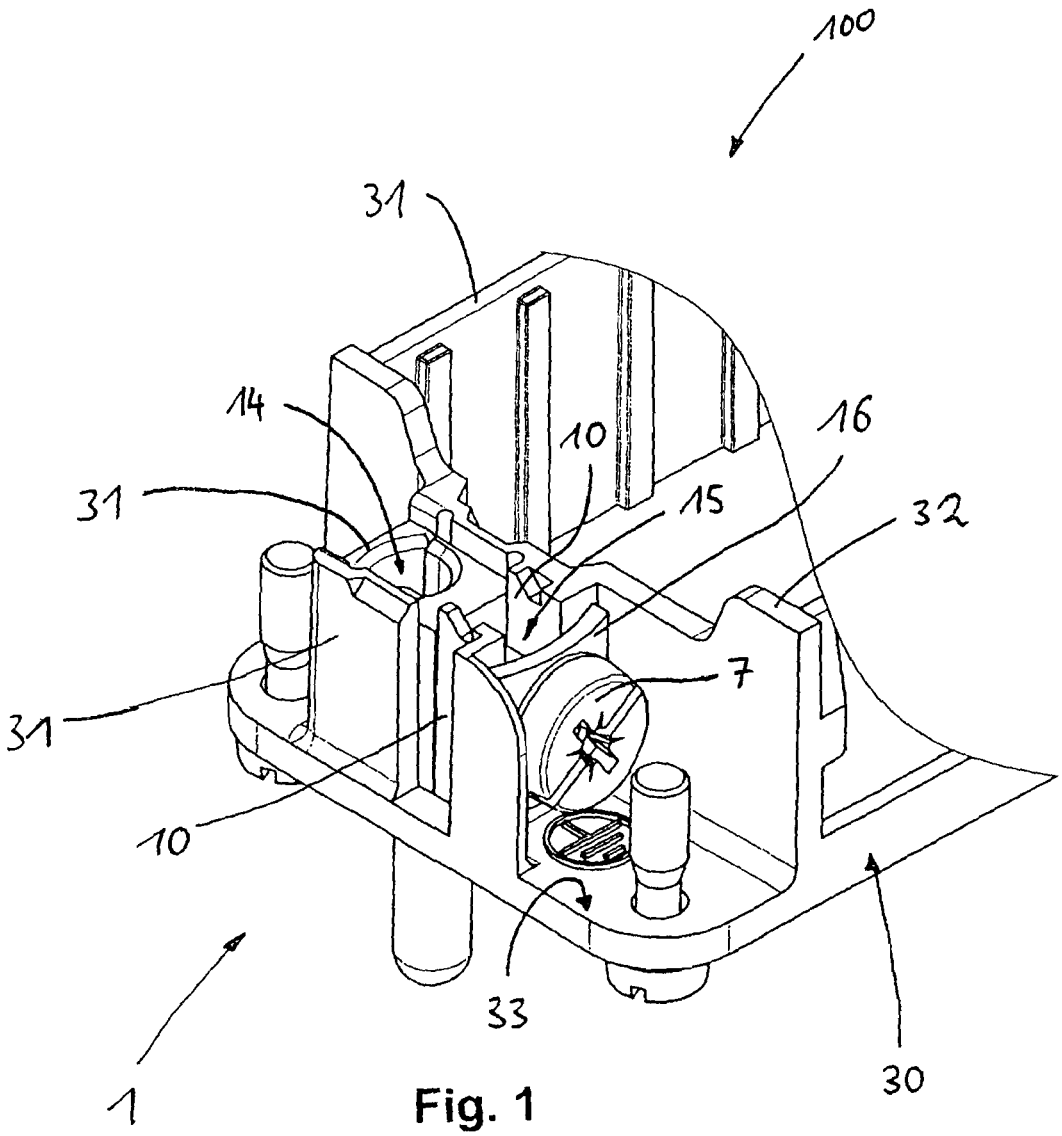
FIG. 1 shows a perspective partial view of a plug connector and, respectively, of a plug connector housing having the protective-ground conductor connection according to the invention.

FIG. 1 shows a detail of a plug connector 100 according to the invention, but in which only a partial detail of the plug connector housing 30 having the protective-ground conductor connection 1 is illustrated. The plug connector housing 30 is, as shown in FIG. 1, in the form of a frame housing on which housing walls 31, 32 are arranged in the longitudinal direction and in the transverse direction, wherein the side walls 32 are arranged transverse to the housing walls 31 which are arranged in the longitudinal direction. Furthermore, further side walls 32 which are formed with a different geometry are formed on the side walls 32. Said side walls 32 of the plug connector housing 30 are formed such that the protective-ground conductor contact 2, which is shown in FIG. 1, can be received in said side walls as a constituent part of the protective-ground conductor connection 1.

The protective-ground conductor contact 2, as in FIG. 2, will be described in greater detail to begin with.

The protective-ground conductor contact 2, according to the present embodiment, is formed from a connection block 4 from which a contact pin 3 projects. The contact pin 3 is in the form of a plug contact. The connection block 4 is in the form of a cuboidal contact block with external side walls 12 and a bearing surface 11 on the bottom face of the connection block 4. In this way, the connection block 4 can be pushed into the protective-ground conductor contact receptacle on the plug connector housing 30 until said connection block rests securely on the housing flange 33 of the plug connector housing 30 by way of the bearing surface 11.

In an advantageous embodiment, the protective-ground conductor contact 2 is pressed "in a non-releasable manner" in the process and forms a permanent connection to the plug connector housing 30. Within the meaning of the present invention, "in a non-releasable manner" is a permanent insertion of the protective-ground conductor contact 2 in the plug connector housing 30.

Figure 2:
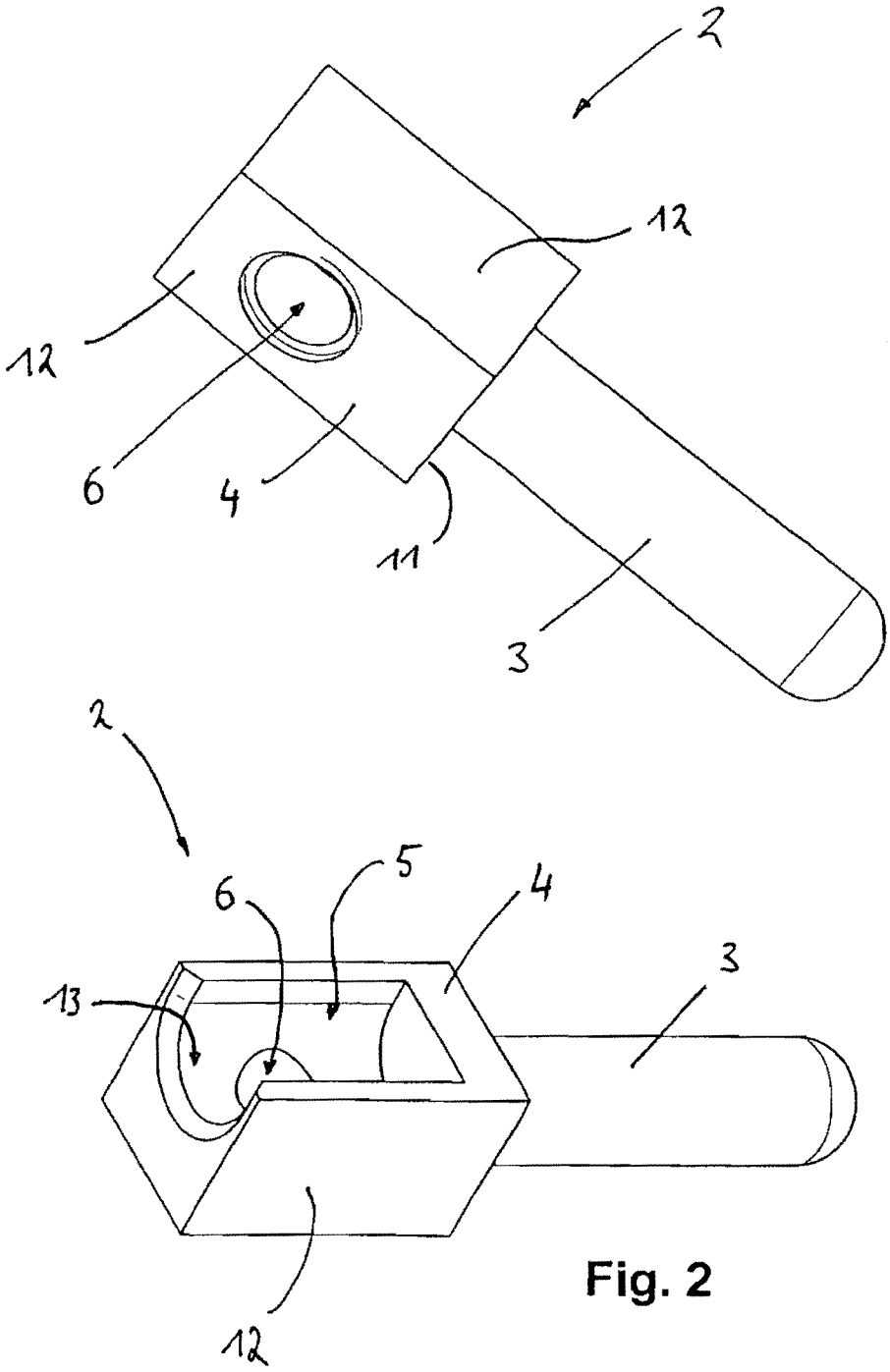
FIG. 2 shows a perspective view of a detail of a contact pin of the protective-ground conductor connection according to FIG. 1.
Figure 3:
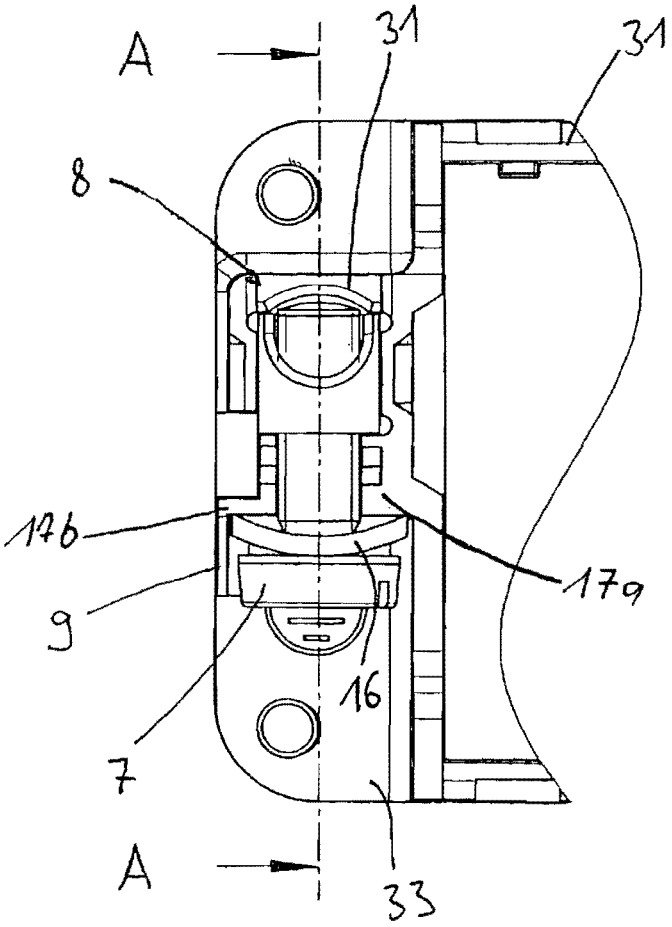
FIG. 3 shows a top view of the design of a plug connector housing having a protective-ground conductor connection in an approximately similar partial view to that in FIG. 1.

As is further shown in FIG. 2, the connection block 4 has a cylindrical recess 5, that is a semi-cylindrical recess 5. A threaded opening 6 for screwing-in a clamping means 7, that is a screw 7, is located in the side wall 12 of the connection block 4, said side wall being illustrated in FIG. 2 and situated opposite the recess 5. This can be clearly seen in FIG. 4 in which a screw 7 is screwed through the threaded opening 6 virtually completely into the first connection region 14. The first connection region 14 is defined as the region which is bounded by the internal cylindrical wall section 13 which is shown in FIG. 2 and the housing wall 32 of the plug connector housing 30 which is adjacent to said cylindrical wall section in FIG. 1, FIG. 3 and FIG. 4.

Figure 4:
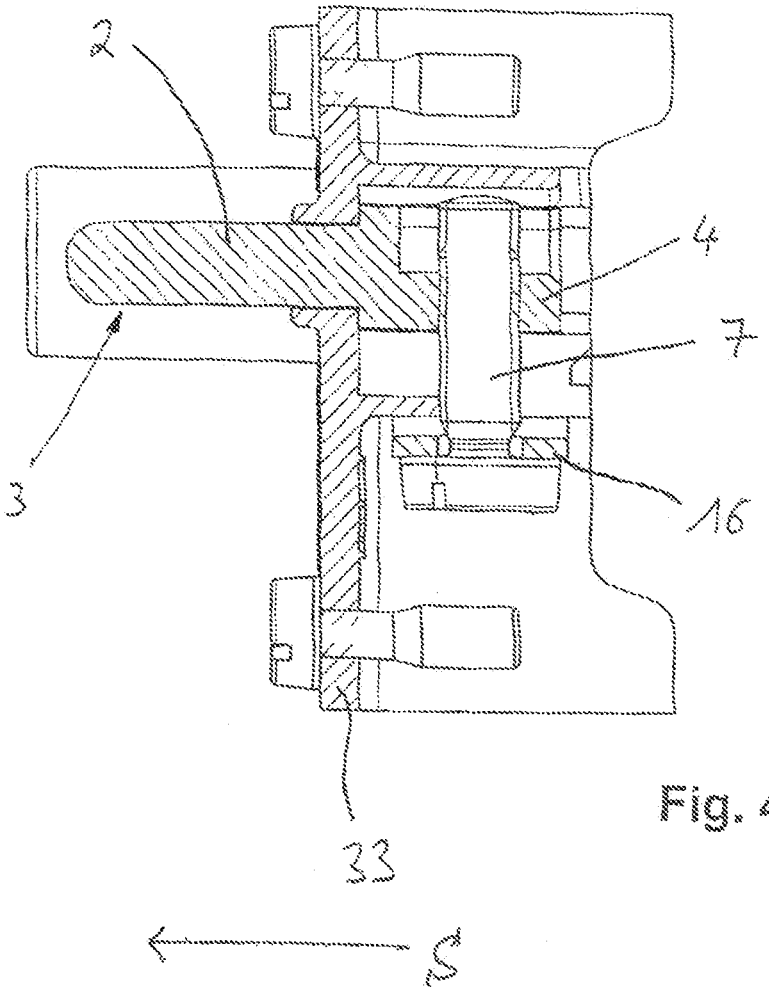
FIG. 4 shows a sectional view according to section line A-A from FIG. 3.

In the mounted position of the protective-ground conductor contact 2 in the protective-ground conductor connection 1 shown in FIG. 4, a second connection section 15 for receiving a second or further line is shown adjacent to the first connection section 14.

The second connection region 15 is formed firstly between housing walls 31 and also that side wall 12 of the connection block 4 which is situated opposite the recess 5, and further by a clamping disk 16 as is clearly shown in FIG. 1.

The screw 7 therefore projects through the second connection region by way of a portion of its threaded section and is partially screwed into the first connection region through the threaded opening 6. In this assembly position, a respective line can be connected, for example, selectively in the first or second connection region 14, 15 or else at the same time in both connection regions. As a result of the screw 7 being operated in the operating direction, the screw end acts on a first line in the first connection region and clamps said first line against the adjacent housing wall 31, while the clamping disk 16 is operated by the screw head in the direction of the side wall 12 of the connection block 4 and receives a line, which is introduced therein, in a clamping manner.

As can further be seen, the housing walls 31, in addition to the U-shaped retaining section 8 for the protective-ground conductor contact 2, also form a locking web 9 and retaining sections 10.

Two locking means 17*a*, 17*b* are formed on the plug connector housing 30, it being possible for side edges of the clamping disk 16 to be supported against said locking means. The retaining sections 10 serve as mating bearings for the connection block 4, in that said connection block, when the clamping means 7, that is to say the screw 7, is operated, is not pulled out against the operating direction, but rather remains securely in its assembly position.

FIG. 4 clearly shows the position of the contact pin 3 which passes through the housing flange 33, as a result of which a protective-ground conductor connection which can be plug-connected and has two connection regions for the connection of lines is provided.

In the embodiment according to FIG. 4, the screwing direction, and therefore the operating direction, of the screw runs transverse to the plugging direction S of the plug connector and therefore to the axial direction of the protective-ground conductor contact 2 and of the contact pin 3. A particularly compact design of a protective-ground conductor connection can be provided in this way.

Alternative refinements are likewise a constituent part of the present invention, even if they are not explicitly mentioned. For example, further embodiments of the connection block can also be provided or additional retaining or locking webs can be provided in order to ensure that the protective-ground conductor contact 2 is securely held on the plug connector housing 30.

LIST OF REFERENCE SYMBOLS

1 Protective-ground conductor connection
2 Protective-ground conductor contact
3 Contact pin
4 Connection block
5 Recess
6 Threaded opening
7 Screw (clamping means)
8 U-shaped retaining section
9 Locking web
10 Retaining section
11 Bearing surface
12 Side walls
13 Semi-cylindrical wall section
14 First connection section
15 Second connection section
16 Clamping disk
17*a*, 17*b* Locking means (housing-end)
30 Plug connector housing
31 Housing walls
32 Side walls
33 Housing flange
100 Plug connector
101 First line
102 Second line
S Plugging direction

The invention claimed is:

1. A plug connector comprising:

a plug connector housing which has housing walls, the plug connector housing having a protective-ground conductor connection for the connection of at least one line connector to the protective-ground conductor connection in a clamping manner, wherein the protective-ground conductor connection has a first connection region for the connection of a first line connector to a clamp which can be operated in a clamping manner, wherein the protective-ground conductor connection further has a second connection region for the connection of a second line connector in a clamping manner by the clamp, and wherein the first connection region is separated from the second connection region by a side wall of a connection block, further comprising a clamping disk fitted to the clamp in the second connection region, wherein the first connection region is formed between a substantially semi-cylindrical wall section of the connection block of the protective-round conductor contact and a housing wall of the plug connector housing, wherein the second connection region is formed between the clamp and the side wall of the connection block, and wherein the side wall is a clamping surface for the second line connector which can be received in the second connection region.

2. The plug connector as claimed in claim 1, wherein the protective-ground conductor connection further has a protective-ground conductor contact with a contact pin and the connection block.

3. The plug connector as claimed in claim 1, further comprising a common clamping means for the connection of a line connector in a clamping manner in each of the connection regions.

4. The plug connector as claimed in claim 1, wherein the clamping means is a screw.

5. The plug connector as claimed in claim 1, wherein the first connection region and the second connection region are in the form of adjacent regions which are separated from one another.

6. The plug connector as claimed in claim 2, wherein the connection block has a semi-cylindrical recess.

7. The plug connector as claimed in claim 1, wherein the clamping disk has a concave curvature in relation to the side wall.

8. The plug connector as claimed in claim 1, wherein the plug connector housing forms two housing-end locking means as a stop for the clamping disk.

9. The plug connector as claimed in claim 1, wherein the contact pin is designed such that it projects at least partially through a housing flange, preferably in the plugging direction of the plug connector housing.

* * * * *

UNITED STATES PATENT AND TRADEMARK OFFICE

CERTIFICATE OF CORRECTION

PATENT NO. : 9,496,652 B2
APPLICATION NO. : 14/410390
DATED : November 15, 2016
INVENTOR(S) : Michael Bertsch It is certified that error appears in the above-identified patent and that said Letters Patent is hereby corrected as shown below:

On the Title Page

Item (22), PCT Filed: replace "June 27, 2013", with --July 27, 2013--.

Signed and Sealed this
Twenty-eighth Day of March, 2017

Michelle K. Lee

Michelle K. Lee
*Director of the United States Patent and Trademark Office*